US005966346A

United States Patent [19]

Arai

[11] Patent Number: 5,966,346

[45] Date of Patent: Oct. 12, 1999

[54] ALARM CLOCK

[75] Inventor: Hideyuki Arai, Fussa, Japan

[73] Assignee: Casio Computer Co., Ltd., Tokyo, Japan

[21] Appl. No.: 08/992,831

[22] Filed: Dec. 17, 1997

[30] Foreign Application Priority Data

Dec. 24, 1996 [JP] Japan ..... 8-344164

[51] Int. Cl.[6] ..... G04B 23/00

[52] U.S. Cl. ..... 368/263; 368/266; 368/261; 368/72

[58] Field of Search ..... 368/72, 23, 252, 368/248, 250, 74, 256, 257, 261, 263, 265, 266

[56] References Cited

U.S. PATENT DOCUMENTS 3,733,802 5/1973 Wisser ..... 368/248

3,817,019 6/1974 Fowler ..... 368/73

5,400,301 3/1995 Rackley ..... 368/72

*Primary Examiner*—Bernard Roskoski

*Attorney, Agent, or Firm*—Frishauf, Holtz, Goodman, Langer & Chick, P.C.

[57] ABSTRACT

An alarm clock includes a time indicator, a first alarm for sounding a first alarm at a preset time, a manual rotary bezel provided rotatable relative to the time indicator outside same for setting a time elapsing from the alarm time, and a second alarm for sounding a second alarm when the time set by the rotary bezel has elapsed since the preset time. After the first alarm is sounded at the alarm time, and after the time set by the rotary bezel has elapsed, the second alarm is sounded. The time interval after which the second alarm is sounded is set by a simple operation and two-staged sounding ensures proper awakening of the sleeper.

4 Claims, 6 Drawing Sheets

ALARM CLOCK

BACKGROUND OF THE INVENTION

This invention concerns an alarm clock which sounds an alarm at a set time.

An alarm clock is known which, if a desired get-up time is set as an alarm time, sounds an alarm when the alarm time is reached.

However, even if the alarm is sounded at the alarm time, the sleeper can operate a stop switch for the alarm to stop same before the sleeper awakes surely, and as a result, oversleep occasionally occurs. In order to solve this problem, alarm clocks are commercialized which sound an alarm again after a fixed time even if the stop switch is operated.

However, an interval of time after which the alarm is conventionally sounded again is fixed in alarm clocks which repeatedly sound their alarms. Therefore, the fixed interval of time is sometimes not suitable for a particular user's life rhythm, so that such an alarm clock can be completely useless for the user.

In order to sound the alarm again after a desired interval of time, the user must prepare two alarm clocks and set a first alarm time in one alarm clock, and a second alarm time in the other alarm clock. That is, not only are two alarm clocks required but also two alarm times are required to be set, which is annoying.

It is an object of this invention to provide an alarm clock which is capable of easily changing an interval of time after which a second alarm is sounded.

SUMMARY OF THE INVENTION

In order to achieve the above object, according to this invention, there is provided an alarm clock comprising:

a time indicator;

first alarm for sounding a first alarm at a preset time;

a manual rotary provided rotatable relative to the time indicator outside said time indicator for setting a time elapsing from the preset time; and a second alarm for sounding a second alarm when the time set by the rotary member has elapsed since the preset time.

According to this composition, a time interval from the time when the first alarm is sounded to the time when the second alarm is sounded is set easily. This two-staged alarming system ensures proper awakening of the sleeper.

DETAILED DESCRIPTION

Figure 1A:
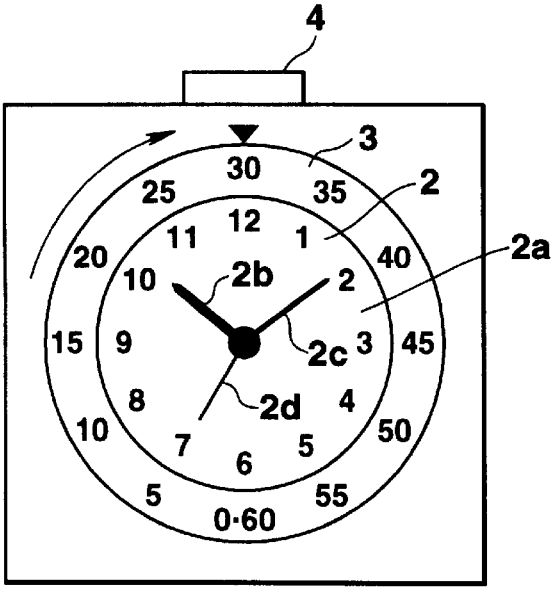
FIG. 1A is a front view of one embodiment of an alarm clock of this invention.
Figure 1B:
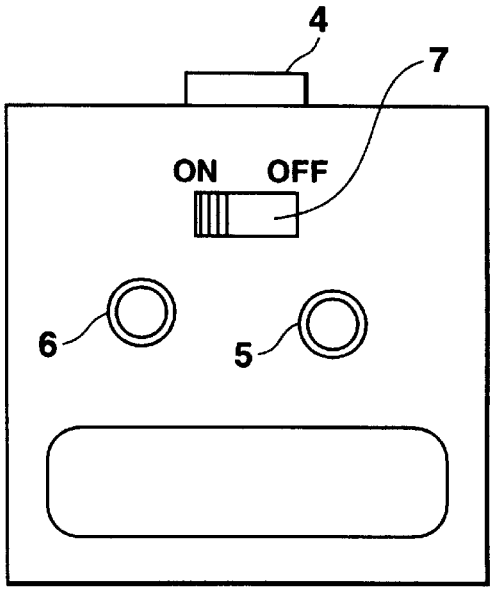
FIG. 1B is a back view of the alarm clock of FIG. 1A.

One embodiment of the alarm clock of this invention will next be explained referring to the drawings. FIGS. 1A and B are a front and a back view, respectively, of the alarm clock. The alarm clock 1 consists of a time indicating section 2, and an outer rotary bezel 3 concentric with, and rotatable relative to, the time indicating section. A stop key 4 is provided on an upper side of the clock 1 to stop an alarm temporarily. Provided on the back of the clock 1, as shown in FIG. 1B, are a time setting knob 5 which sets a time, an alarm time setting knob 6 which sets an alarm time, and an alarm on/off switch 7 which determines whether the alarm should be sounded.

The time indicating section 2 comprises a dial 2*a*, an hour hand 2*b*, a minute hand 2*c*, and an alarm hand 2*d* which indicates an alarm time. The time which the hour and minute hands 2*b* and 2*c* indicate can be freely corrected by manipulating the time setting knob 5 provided on the back of the main body of the alarm clock 1. The alarm time can freely be set by operating the alarm time knob 6.

Figure 2:
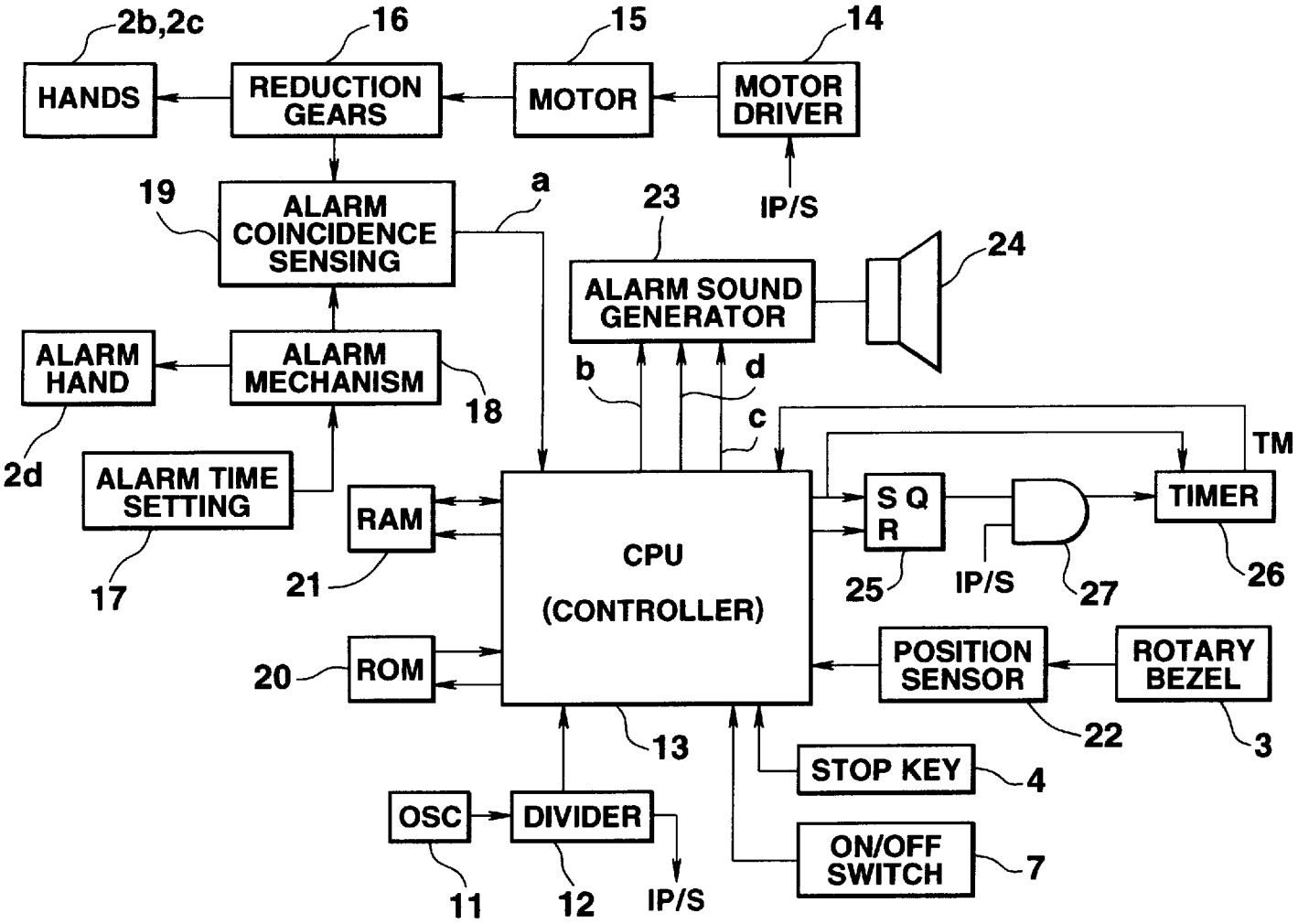
FIG. 2 is a circuit block diagram of the alarm clock.

A driving mechanism and circuit of the alarm clock 1 will be explained in FIG. 2. A high frequency signal generated by an oscillator 11 is divided by a frequency divider 12 to provide a clock signal which becomes the standard of the operation of a CPU 13 and a time recording signal of 1 Hz for time recording/measuring purposes. The clock signal is output and delivered to CPU 13, and the timing signal of 1 Hz is delivered to a motor driver 14 and an AND gate 27. The motor driver 14 generates a drive signal for the motor 15 on the base of the 1 Hz signal, and feeds the drive signal to motor 15. The rotational speed of the motor 15 is decreased by gears 16 to move the hour and minute hands 2*b* and 2*c* step by step. An alarm time set mechanism 17 transmits information on the time set by the alarm time setting knob 6 to the alarm mechanism 18 and sets the alarm time. An alarm coincidence detection mechanism 19 monitors the alarm time set in the alarm mechanism 18 and the current time which the gears 16 tick away, and outputs a coincidence detection signal a to CPU 13 when the current time coincides with the alarm time.

The rotary bezel 3 sets a time interval from the time when the sounding of a first alarm A ends to the time when the sounding of a second alarm B starts. Numerals "0", "5", "10", "15", . . . "60" each indicating a time elapse in minutes are printed or inscribed on the rotary bezel 3. An arrow head mark is printed outside the rotary bezel 3 at 12 o'clock of the face 2*a*. A desired time period from the time when the sounding of a first alarm A ends to the time when the sounding of a second alarm B starts is set by rotating the rotary bezel 3 to set an appropriate numeral to the position of the arrow head mark.

Figure 3:
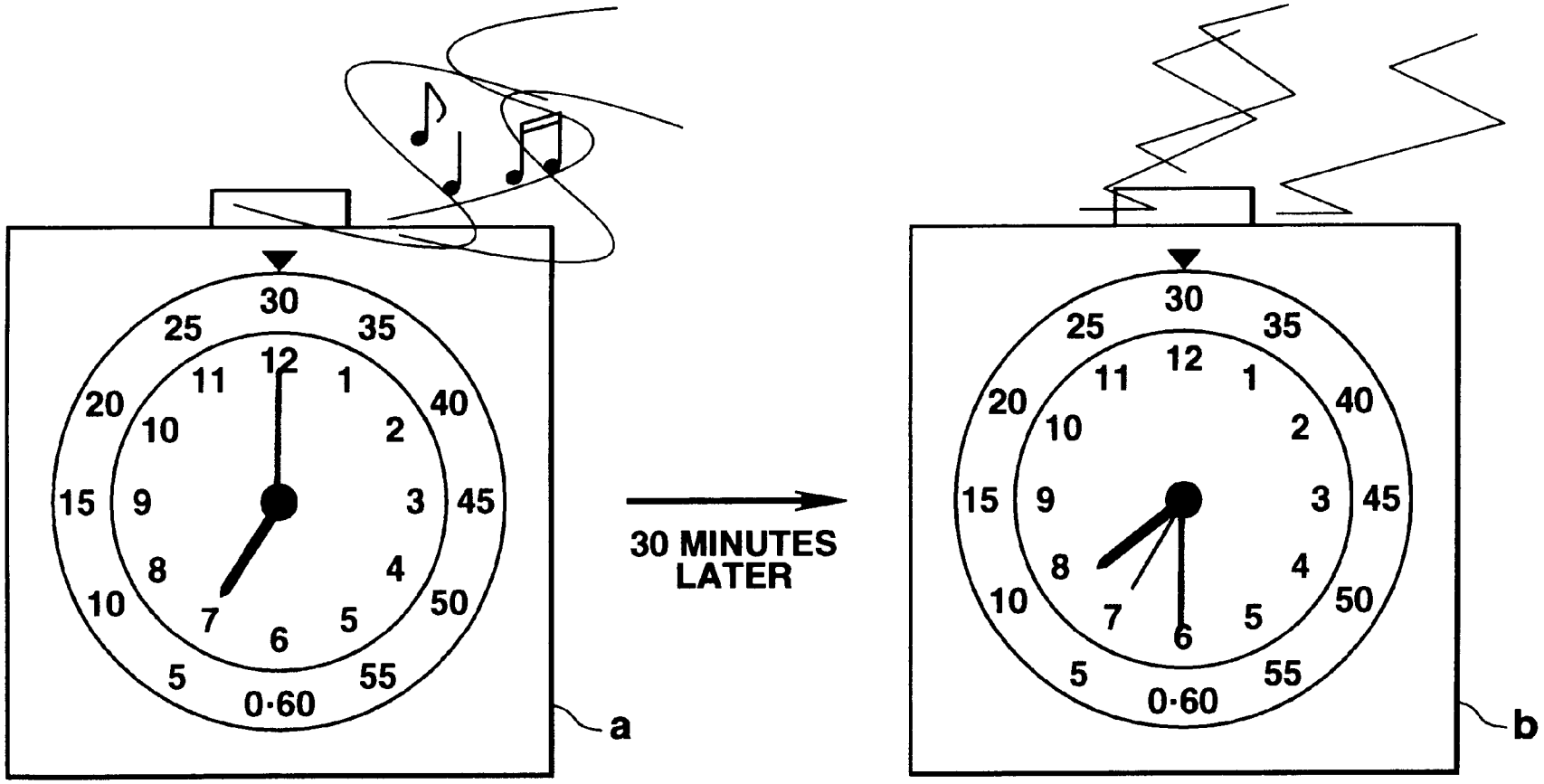
FIG. 3 shows the state of an alarm clock sounding an alarm.

FIG. 3 shows the states a and b where alarms A and B, respectively, are sounded. As shown by a in FIG. 3, when the current time becomes 07:00 a.m., the alarm A is sounded in the form of a melody. In this case, because the arrow head mark is set to a numeral "30" on the rotary bezel 3, the alarm B is sounded in the form of a buzzer sound larger than the melody sound to a lapse of 30 minutes since the alarm time.

Referring back to FIG. 2, a position sensor 22 senses the rotational position of the bezel 3 and outputs a corresponding digital value signal to CPU 13. CPU 13 executes a time updating process, an alarm sounding process, etc., in accordance with programs stored in a ROM 20. When CPU 13 receives an alarm coincidence detection signal a from an alarm coincidence detection mechanism 19, it outputs a signal b to start the sounding of the first alarm A to an alarm sound generator 23 to generate an alarm signal to thereby cause a speaker 24 to output the alarm A in the form of a melody. When CPU 13 receives the alarm coincidence detection signal a, it sets a flip-flop 25 and starts up the timer 26. When flip-flop 25 is set, a 1 Hz signal applied to one input of AND gate 27 is inputted to an input of the timer 26 via AND gate 27. The timer 26 counts 1-Hz signals to measure a time lapse from the starting of sounding the alarm A, and outputs information on the measured time to CPU 13. When a predetermined time (for instance, of one minute) elapses from the start of sounding the melody alarm, CPU 13 outputs an alarm stop signal c to the alarm sound generator 23 and stops sounding the alarm. In addition, if the timer time measured by timer 26 coincides with the time set by the rotary bezel 3, CPU 13 outputs a signal d to start sounding the alarm B to the alarm sound generator 23 to cause same to start sounding the second alarm B. When a predetermined time has passed since the sounding of this alarm B started, an alarm stop signal c is outputted from CPU 13 to the alarm sound generator 23 to stop sounding the alarm B. The detection signals from the stop key 4 and alarm on/off key 7 are outputted and delivered to CPU 13.

Figure 4:
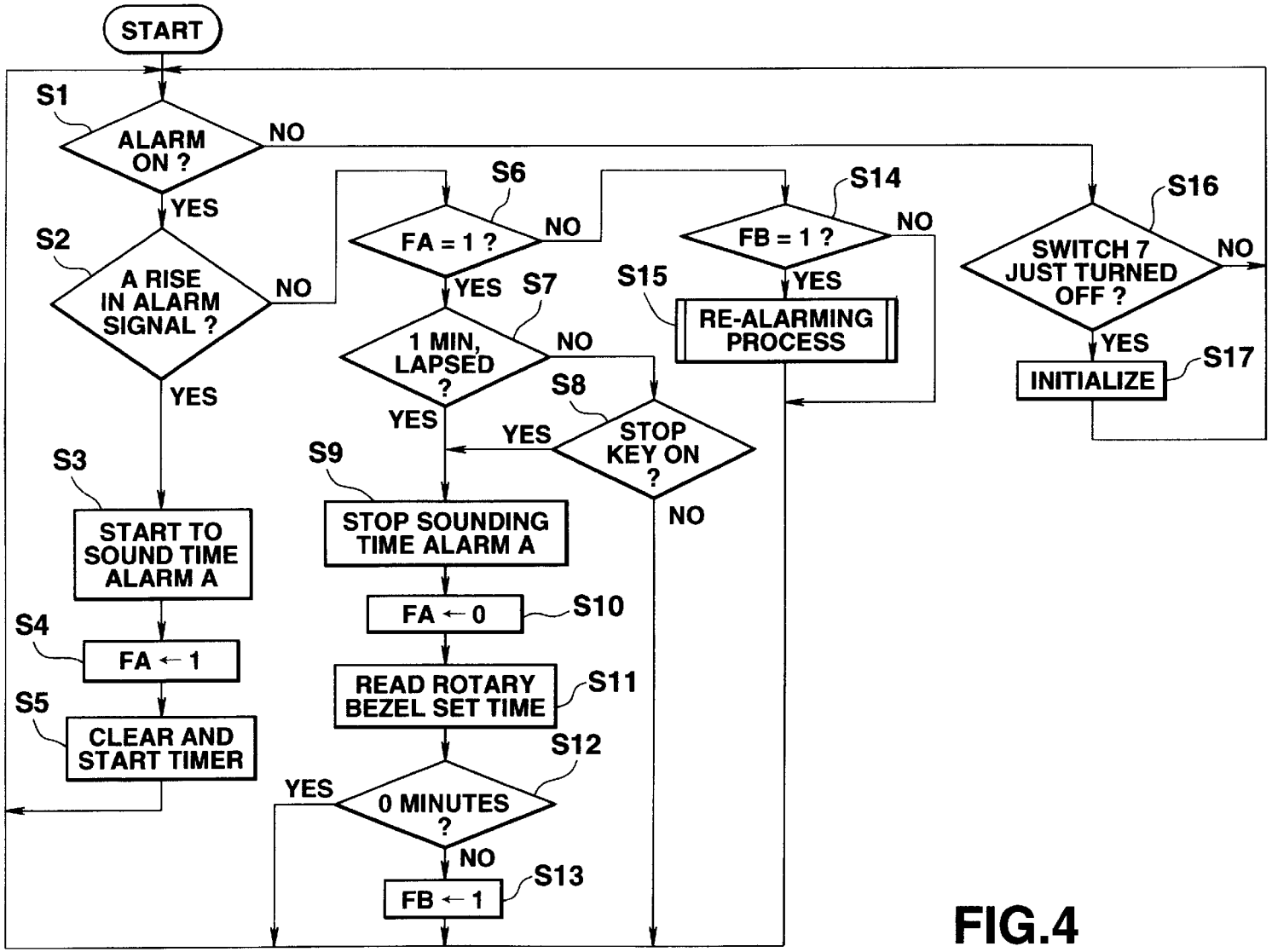
FIG. 4 is a flow chart of a schematic operation of the alarm clock.
Figure 5:
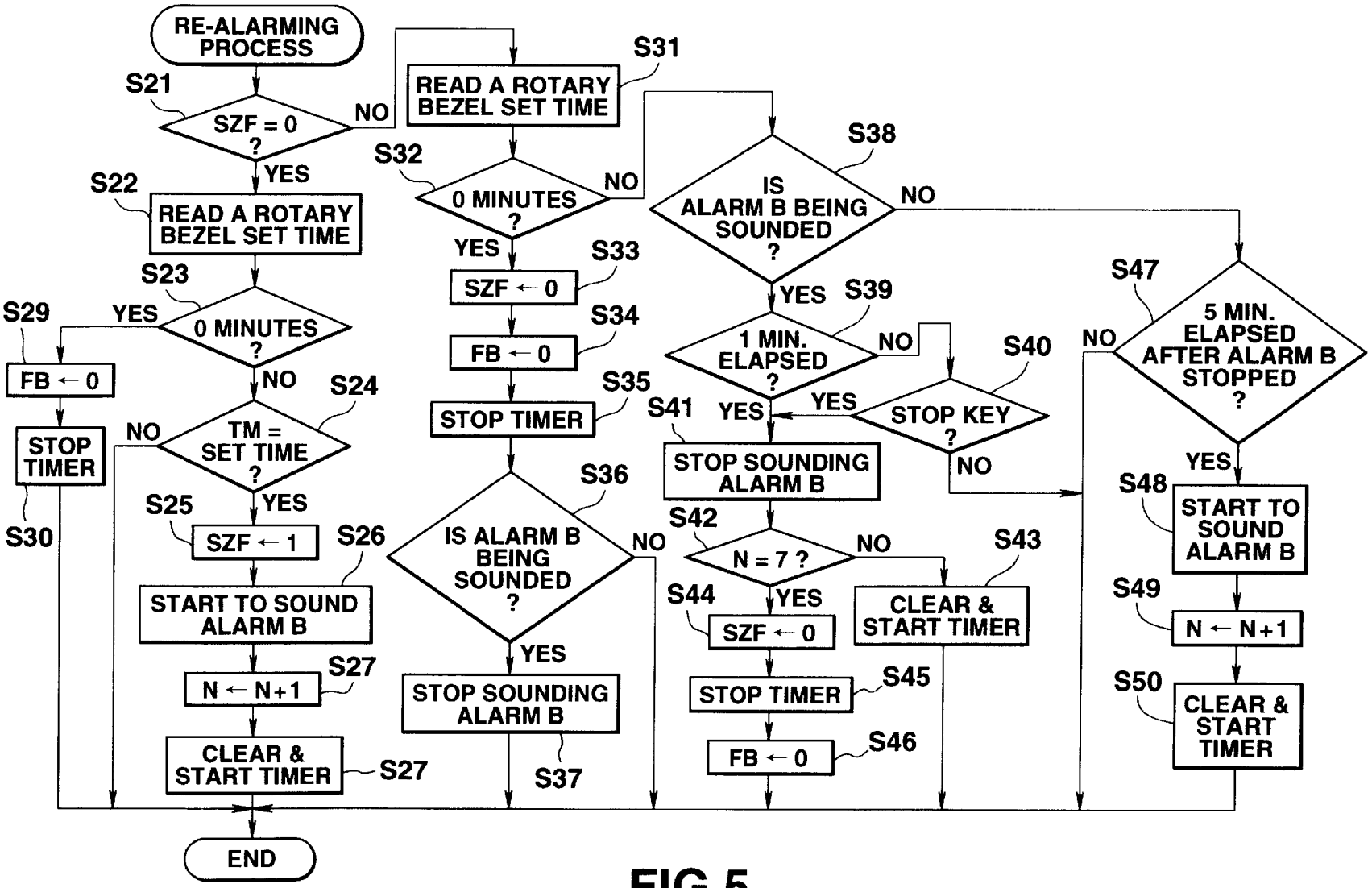
FIG. 5 is a flow chart of a re-alarming process performed in FIG. 4.

Next, the operation of the alarm clock 1 will be explained referring to the flow charts of FIGS. 4 and 5. First of all, the entire operation of the alarm clock 1 will be explained. Step S1 of FIG. 4 determines whether the alarm on/off switch 7 is on. If so, control passes to step S2 which determines whether a rise in the alarm signal or in the alarm coincidence detection signal a outputted by the alarm coincidence detection mechanism 19 has occurred. If so, the control passes to step S3 which outputs a signal b to start to sound the alarm A to the alarm sound generator 23 to cause same to produce an alarm A signal to thereby sound the alarm A. Step S4 sets "1" in flag FA to sound the alarm A for one minute at the alarm time. Simultaneously, step S5 clears and starts up the timer 26 to start to sound the alarm A and starts to measure a time lapse from the start of sounding the alarm A.

If step S2 determines that no rise occurred in the alarm coincidence signal a, the control passes to step S6 which determines whether the flag FA is 1" or whether the alarm A should be sounded. When flag FA is "1", and the alarm A is sounded, step S7 determines whether one minute has elapsed after the start of sounding of the alarm A. When one minute has not elapsed since the start of sounding the alarm A, the control passes to step S8, which determines whether the stop key 4 is on. If not, the control returns to step S1 to perform the corresponding process and subsequent processes.

When one minute has elapsed after the sounding of the alarm A at step S7, or when the stop key 4 is turned on before one minute has elapsed, the control passes to step S9, which stops sounding the alarm A. Thus, step S10 sets "0" in flag FA and step S11 reads the set time of the rotary bezel 3. Step S12 determines whether the set value read from the rotary bezel 3 is 0. If not, or if a time interval after which sounding the second alarm B is started is set, step S13 sets "1" in flag FB which indicates whether sounding the second alarm B should be started. When flag FB is "1", and when the time measured by the timer 26 coincides with the set time of the rotary bezel 3, the second alarm B is sounded. When flag FB is "0", the second alarm is not sounded.

When flag FA is not "1" at step S6, or when the first alarm A is not sounded, the control passes to step S14, which determines whether flag FB is "1". If so, or if the second alarm B is set so as to be sounded, step S15 performs a re-alarming process.

When the alarm on/off switch 7 is not on at step S1, control passes to step S16, which determines whether the switch 7 was just turned off. If so, step S17 performs an initializing process which includes stopping the sounding of the alarm if this is being performed, stopping the timer operation if this is being performed, and setting flags FA and FB at "0".

The contents of the re-alarming process at step S15 of FIG. 4 will be described with respect to FIG. 5. First, step S21 determines whether a snooze flag NZF is "0", If so, or if the current period is not a snooze one, step S22 reads the set time of the rotary bezel 3. Step S23 determines whether the read set time is 0.

When the set time is not 0, or when a time period after which the second alarm B is sounded is set by the rotary bezel 3 is set, step S24 determines whether the time measured by the timer 26 coincides with the time set by the timer 26. If not, the processing is terminated. Conversely, if so, control passes to step S25, which sets snooze flag SZF at "1". This implies that the time set by the rotary bezel 3 has elapsed since the alarm time. Thus, the next step S26 outputs a signal d to start sounding the alarm B to the alarm generator 23 to cause same to sound the second alarm B. Step S27 increments by one a register N which counts the number of snoozes. Then, step S28 clears and starts the timer 28.

When the set time of the rotary bezel 3 is 0 minutes at step S23, it is implied that after the first alarm A is sounded, the time set by the rotary bezel 3 is changed to 0 in a state where the second alarm B is to be sounded. Thus, step S29 resets flag FB at 0 and then step S30 stops the time measuring operation of the timer 26.

When step S21 determines that snooze flag SNZ is not 0, step S31 determines whether the set time of the rotary bezel 3 is 0. If so, it is implied that the set time of the rotary bezel 3 is changed to 0 minutes during the snooze period when the alarm B is sounded. Thus, the control passes to step S33, which sets snooze flag SNZ at 0. Step S34 then resets flag FB at 0 and step S35 stops the timer 26 which measures a time period after which the alarm B is sounded. Step S36 determines whether the alarm B is being sounded. If so, the next step S37 stops sounding the alarm.

That is, when the set time of the rotary bezel 3 was changed to 0 during the snooze period, the snooze flag SZF and the flag FB which indicates whether an alarm is again sounded are set to 0 to stop sounding the alarm.

If step S32 determines that the set time of the rotary bezel 3 is not 0 minutes, the control passes to step S38, which determines whether the alarm B is being sounded. If so, the next step S39 determines whether one minute has elapsed since sounding the alarm B started. If not, the control passes to step S40, which determines whether the stop key was operated. If one minute has elapsed since sounding the alarm B started, or if the stop key 4 is operated during sounding of the alarm B, step S41 stops sounding the alarm B. The next step S42 determines whether the value of register N which stores the snooze count is 7 or whether the current period is a seventh snooze one. If not, the control passes to step S43, which clears and starts the timer 26. The timer 26 measures a time lapse since one minute after sounding the alarm B started or since sounding the alarm B stopped due to the depression of the stop key during sounding of the alarm B. When the time lapse exceeds five minutes, the alarm B is again sounded.

When step S42 determines that the current snooze period is a seventh one, the control passes to step S44, which sets the snooze flag at 0. The next step S45 stops the measurement of the timer 26. Furthermore, step S46 sets flag FB at 0.

When step S38 determines that the alarm B is not being sounded, the control passes to step S47, which determines whether five minutes have elapsed after sounding the alarm B stopped. If not, the control stops the processing at that point of time.

If so at step S47, it is implied that five minutes of the snooze pause period have elapsed. Thus, the control passes to step S48, which starts to sound the alarm B. Step S49 increments by one the value of register N which stores the snooze count and further clears and starts the timer 26 to cause same to start to measure one minute of a sounding time of the alarm B.

As described above, after the first alarm A is sounded at the alarm time, the second alarm B is sounded after a lapse of the time set by the rotary bezel 3. Thus, even when the sleeper is not awaked sufficiently by the first alarm A, he or she will be completely awakened by the second alarm B. The time interval after which the second alarm is sounded is set by the rotary bezel 3 provided rotatably concentric with and outside the dial 2, so that the setting operation is very simple and the set time can easily be confirmed.

Figure 6:
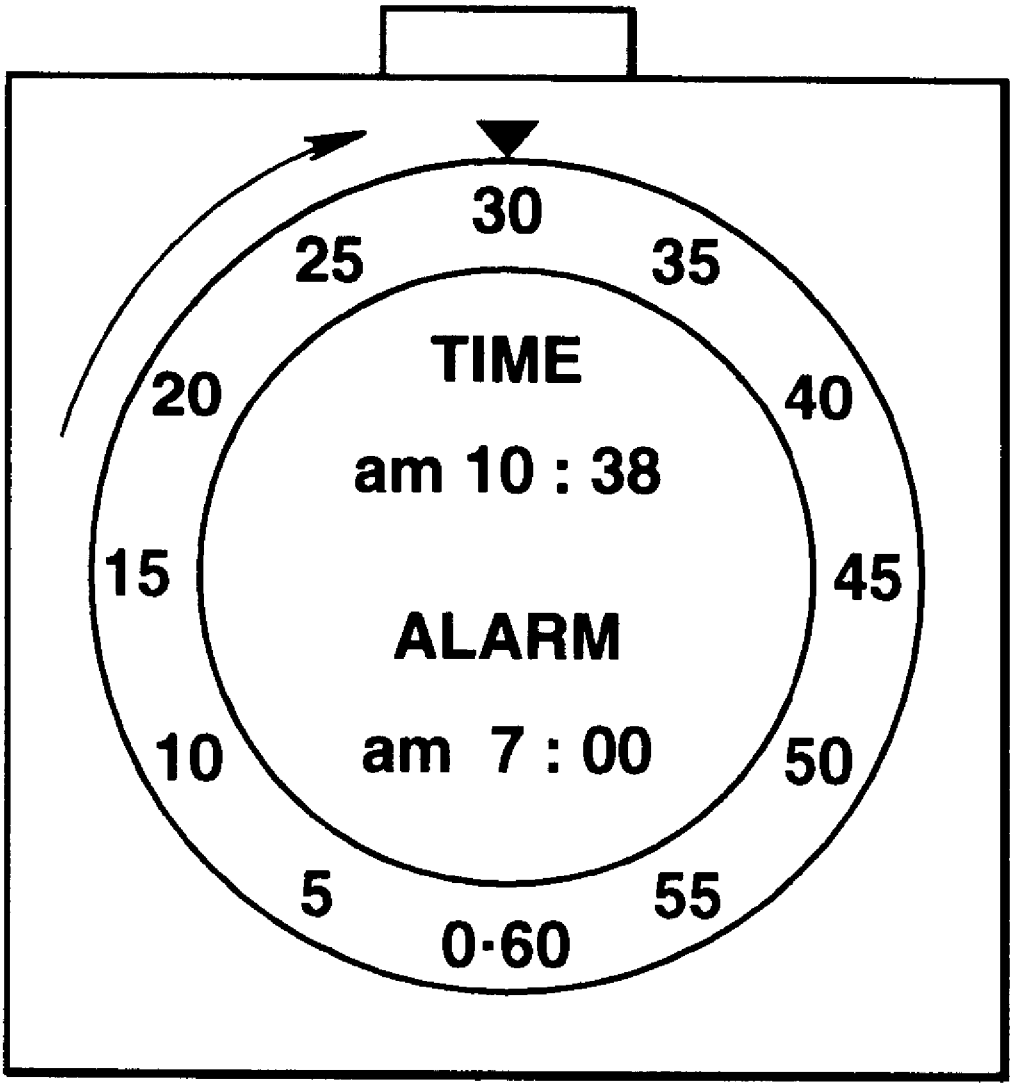
FIG. 6 shows a modification.

While the above embodiment is illustrated as being applied to an analog-display alarm clock, this invention may be applied to a digital-display alarm clock, as shown in FIG. 6. Furthermore, this invention is applicable to not only timepieces having a clock function only but also other electronic devices having a clock function.

What is claimed is:

1. An alarm clock comprising:

a time indicator having a time hand for indicating a time and an alarm hand for indicating a preset alarm time;

a first alarm which is sounded at the preset alarm time;

a ring-like manual rotary member which is rotatable around a periphery of said time indicator to a given position for setting a period of time following the preset alarm time, said ring-like manual rotary member being held at the given position in a direction of its rotation until said manual rotary member is next rotated;

a detector for detecting the given position of said manual rotary member in the direction of its rotation;

a count-down timer circuit which sets the period of time following the preset alarm time in accordance with the given position of the ring-like manual rotary member detected by the detector;

a count-down start controlling circuit for causing said count-down timer circuit to count down the period of time following the preset alarm time responsive to the first alarm being sounded; and a second alarm which is sounded when the period of time following the preset alarm time is counted down to zero by said count-down timer circuit.

2. The alarm clock according to claim 1, wherein a sound of the first alarm is different than a sound of the second alarm.

3. The alarm clock according to claim 1, wherein the second alarm comprises a plurality of subalarms, and said second alarm sounds the plurality of subalarms at predetermined intervals of time.

4. The alarm clock according to claim 1, further comprising:

a mark fixed on said alarm clock in a vicinity of said ring-like manual rotary member; and a numeral scale disposed on a periphery of said ring-like manual rotary member;

wherein the period of time following the preset alarm time set by said ring-like manual rotary member is indicated by a numeral on the numeral scale which is closest to the mark fixed on said alarm clock.

* * * * *